United States Patent [19]

Easley et al.

[11] Patent Number: 4,976,301

[45] Date of Patent: Dec. 11, 1990

[54] FOLDED PRESTRUNG SHADE AND PACKAGE

[76] Inventors: Madlyn Easley, 53 Bretton Rd., West Hartford, Conn. 06119; Robin Fisher, 23 Charter Oak Pl., Hartford, Conn. 06103

[21] Appl. No.: 696,437

[22] Filed: Jan. 30, 1985

Related U.S. Application Data

[63] Continuation-in-part of Ser. No. 653,317, Sep. 24, 1984, Pat. No. 4,899,796.

[51] Int. Cl.[5] ..... A47H 5/00

[52] U.S. Cl. ..... 160/84.1; 206/326; 223/37

[58] Field of Search ..... 160/84 R; 206/326; 223/37

[56] References Cited

U.S. PATENT DOCUMENTS

| | | | |
|---|---|---|---|
| 149,770 | 4/1874 | May | 160/84 R |
| 1,956,116 | 4/1934 | Carver . | |
| 2,310,014 | 2/1943 | Apfel | 160/84 R |
| 2,528,652 | 11/1950 | Gundlach . | |
| 2,620,027 | 12/1952 | Eisenberg . | |
| 2,910,120 | 10/1959 | Rosen . | |
| 3,160,202 | 12/1964 | Rosen . | |
| 3,528,477 | 9/1970 | Abraham . | |
| 3,593,772 | 7/1971 | Abraham . | |
| 3,777,800 | 12/1973 | Susoev . | |
| 3,913,655 | 10/1975 | Ogino . | |
| 3,952,788 | 4/1976 | Scholer . | |
| 3,964,781 | 6/1976 | Fenton | 160/84 R |
| 3,999,590 | 12/1976 | Koch . | |
| 4,069,857 | 1/1978 | Brookshire . | |
| 4,088,170 | 5/1978 | Franklin . | |
| 4,397,346 | 8/1983 | Chumbley et al. . | |

*Primary Examiner*—Ramon O. Ramirez
*Assistant Examiner*—Robert A. Olson
*Attorney, Agent, or Firm*—Ira S. Dorman

[57] ABSTRACT

A packaged balloon shade is folded initially in laterally extending pleats, to minimize the amount of unsightly wrinkling apparent in the hung drape, to facilitate manufacture and installation, and to avoid unnecessary waste of cord used for the operating drawstrings.

8 Claims, 4 Drawing Sheets

FOLDED PRESTRUNG SHADE AND PACKAGE

CROSS-REFERENCE TO RELATED APPLICATION

This application is a continuation-in-part of copending application Serial No. 653,317 entitled BALLOON SHADE CONSTRUCTION, filed on Sept. 24, 1984, now patent 4,899,796 issued Feb. 13, 1990.

BACKGROUND OF THE INVENTION

When decorative curtains and drapes are to be packaged, such as for mail-order sale and the like, it is common practice to first fold or gather them laterally and then to fold them at right angles to produce a package of convenient size. Alternatively, the laterally folded drape can be rolled upon a cylindrical cardboard core or tube. Such packaging methods are undesirable in certain respects (as will be discussed below), and the rolled package is particularly unsatisfactory from the standpoint of transportation and handling convenience.

So-called "balloon" shades or curtains are currently enjoying considerable popularity as window treatments, especially for home decoration use. Structurally, such a shade consists of a panel of supple fabric, against the rear surface of which a number of rings or other guide elements are secured in a pattern of columns and rows. These elements direct drawstrings upwardly from spaced points of attachment near the bottom of the shade, and then across the top of the shade to a common location adjacent one side for simultaneous operation. The shades are designed to be hung from an overhead rod, and they open vertically by folding upon themselves in laterally extending swags or poufs; generally, a stiffening strip will be inserted along the bottom edge to help maintain proper conformation.

In the case of balloon shades and other vertically operating drapery articles, it has been found that lateral folding produces unsightly wrinkles, which do not normally disappear even after long periods of use and which are not obscured by the natural (i.e., generally horizontally extending) folds of the hung drape. This is in contrast to other types of draperies, which hang in vertically extending folds or pleats. (Perhaps it should be noted here that lateral folding produces folds that are longitudinal or longitudinally extending, and vice versa.)

To install the typical packaged curtain or shade, which is laterally folded or gathered, it is generally necessary to expand the upper portion to enable insertion of the mounting rod. Not only does this tend to be somewhat awkward and inconvenient, but moreover, in a prestrung shade such extension will tend to unthread the drawstrings from at least some of the guide elements if the cords are not of sufficient length. Generally, the manufacturer will make the drawstrings excessively long to prevent this from happening; this is of course wasteful, and adds unnecessarily to the cost of the goods.

Furthermore, the method heretofore used to string shades of this type has not been optimal, from the standpoint of manufacturing speed and efficiency.

A considerable variety of shade and curtain constructions is disclosed in the art, as evidenced by the following United States patents: Nos. 1,956,116; 2,528,652; 2,620,027; 2,910,120; 3,160,202; 3,528,477; 3,593,772; 3,777,800; 3,913,655; 3,952,788; 3,999,590; 4,069,857; 4,088,170; and 4,397,346. However, none of the foregoing addresses the problems or disadvantages of prior packaging techniques, discussed above.

Accordingly, it is an object of the present invention to provide a novel drapery package assembly comprised of a prestrung drapery article which is folded to enable convenient handling and shipping, such as for mail-order sale, and yet which facilitates installation and minimizes the amount of unsightly wrinkling in the hung curtain or shade.

It is also an object of the invention to provide such a package assembly which enables substantial enhancement of the economy and efficiency of manufacture, and of the convenience and ease of installation.

Another object of the invention is to provide a novel method for producing a packaged, prestrung drapery article, which method is of enhanced efficiency and economy and increases the convenience and simplicity of installation, while minimizing the amount of unsightly wrinkling apparent in the hung drapery.

SUMMARY OF THE DISCLOSURE

It has now been found that certain of the foregoing and related objects of the invention are readily attained in a drapery package assembly, including a prestrung, pleated drapery article, and means for maintaining the article in pleat-folded condition. The drapery article is comprised of a panel of supple material having means defining a rod-receiving sleeve portion extending laterally along its upper margin, a multiplicity of guide elements arranged in a plurality of rows and columns on one side of the panel, and a plurality of drawstrings attached to the lower portion of the panel at laterally spaced locations corresponding to the columns of guide elements. The drawstrings are threaded upwardly through the guide elements to the uppermost row thereof, and are guided thereby to one lateral edge of the panel for simultaneous operation of the installed drapery article to elevate the lower portion, such operation causing the panel to fold longitudinally upon itself along generally laterally extending natural fold lines at levels corresponding to the rows of guide elements. In packaged condition, the drapery article is folded upon itself in a series of overlapping pleats formed along the rows of guide elements (other than the uppermost row), without gathering it in the lateral direction and substantially without producing longitudinally extending creases. As a result, the drapery article requires no extension from its packaged condition (except for minimal unfolding) to enable insertion of the mounting rod through its sleeve portion for installation and, when it is hung, the drapery will be substantially free of creases other than those that extend generally laterally along the natural fold lines, associated with the pleats.

In most cases, the drapery article will be folded upon itself in a lateral direction to reduce it to a convenient size for packaging, after the pleats have been made, and generally it will be maintained in a bag or like receptacle. In the preferred embodiments the article will be a balloon shade; most desirably the approximate lengths of the drawstrings will be determined in accordance with the formula:

$$D_n = 1.5\ L + 11\ (n-1)$$

wherein "n" represents the position number of the drawstring, progressing from the "one" lateral edge of the panel, "D" is the length of the drawstring, and "L" is the length of the panel, both lengths being expressed in inches. Normally, the panel will be of generally rectangular configuration, and the supple material of which it is made will be a cloth fabric.

Other objects of the invention are attained by the provision of a method for producing a packaged, prestrung drapery article having the structural and functional features described above. In the practice of the method, the panel is first longitudinally folded repeatedly upon itself along the rows of guide elements, to form a series of laterally extending overlapping pleats, following which the drawstrings are threaded through the guide elements to extend from one lateral edge of the panel, along the uppermost row of elements and to the bottom portion of the panel, with one of the drawstrings passing through each of the columns of guide elements. Either before or after assembly, an end portion of each of the drawstrings will of course be affixed to the panel at a point adjacent the lower end of the column of guide elements through which it is, or is to be, threaded.

In its preferred embodiments, the method will additionally include the step of cutting pieces of cord from a continuous-length supply thereof to provide the drawstrings, with the threading step preceding the steps of affixing and cutting the cord. The lengths of the pieces of cord are advantageously determined in the manner previously indicated, and the method will normally additionally include the steps of laterally folding pleat-folded panel upon itself at least once and of securing the article to maintain the fully folded condition, the latter usually being accomplished by placing it into a bag or like receptacle.

DETAILED DESCRIPTION OF THE ILLUSTRATED EMBODIMENTS

Figure 1:
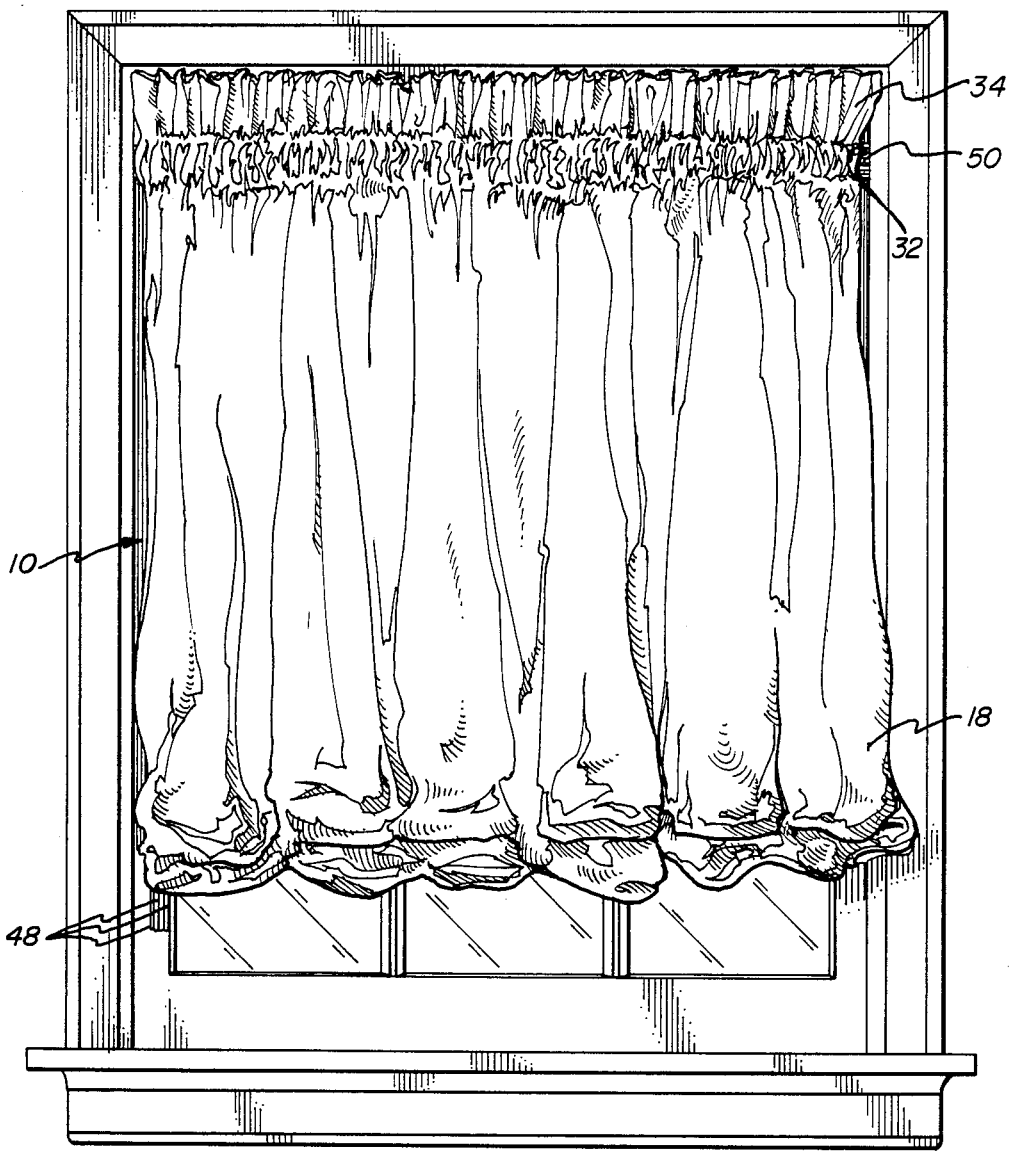
FIG. 1 is an elevational view of a balloon shade assembly embodying the present invention, installed in typical fashion within a window frame.
Figure 6:
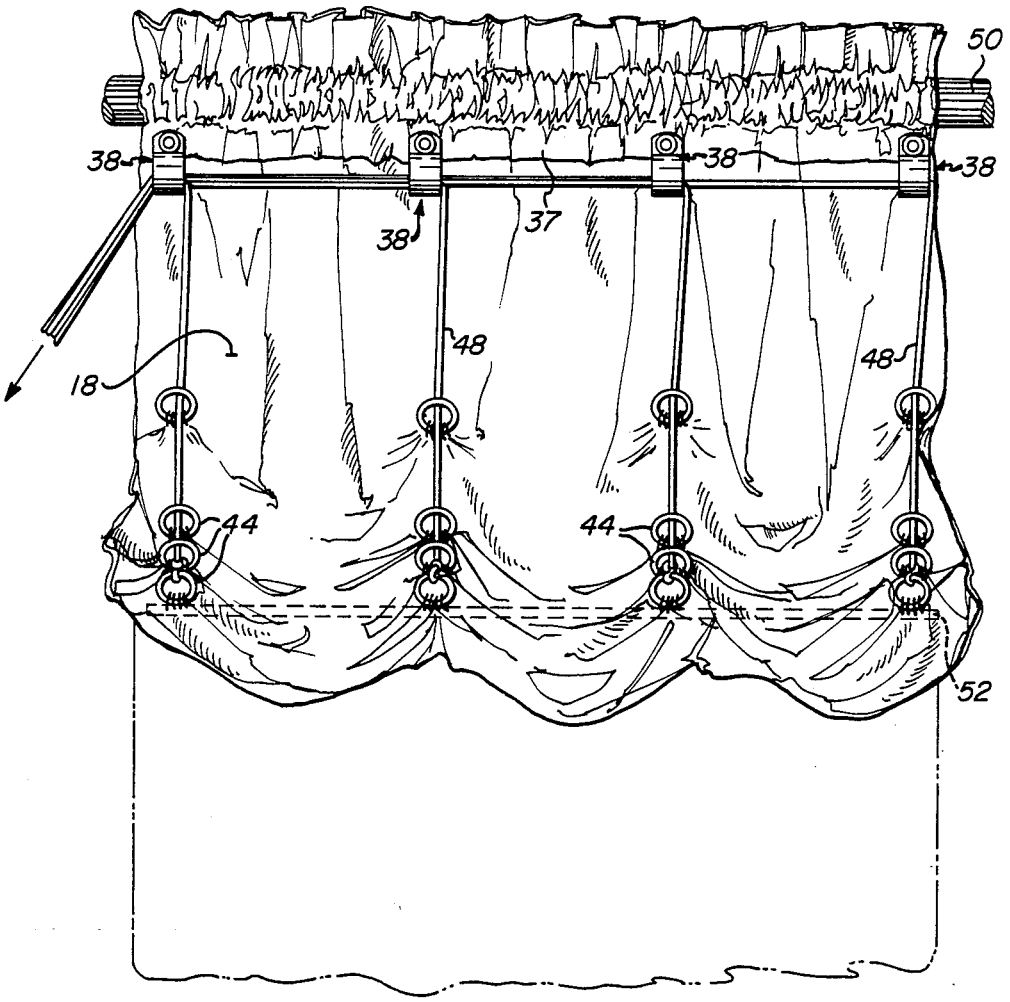
FIG. 6 is a rear view similar to FIG. 1, but showing the shade from the rear and partially elevated, suggesting the window area in phantom line.

Turning now in detail to the appended drawings, a balloon shade typically employed in the packaging assembly and method of the present invention is shown in FIGS. 2–5, and as installed in FIGS. 1 and 6. The shade consists of a rectangular piece of material (usually a textile fabric), generally designated by the numeral 10, folded inwardly upon itself along its sides and secured, to provide finished lateral edges 12, and folded downwardly and upwardly upon itself at the top and bottom to provide upper and lower marginal portions 14 and 16, respectively. The lower marginal portion 16 is sewn to the main body portion 18 along two laterally extending parallel lines 20, 22, to define therebetween a lower sleeve pocket 24 and a bottom hem 26.

The upper marginal portion 14 is similarly stitched to the main panel 18 along parallel lines 28, 30, to define an upper sleeve pocket 32 and top hem 34. The lower edge section 36 on the marginal portion 14 is folded upwardly to a position against the main body portion 18, and is held in place between the facing sections by the stitching 30; in this manner, a double thickness of material is provided as a flange or flap 37 along the lower edge of the upper portion 14.

A number of loops, generally designated by the numeral 38, are affixed to the double-thickness flange 37 at spaced locations across the width of the shade to provide the uppermost row of guide elements. As can be seen, each loop 38 is made from a strip or band of material 40, formed into a generally circular configuration and secured through its end portions to the flange 37 by a pop rivet 40, to provide laterally extending channels 42 across the top of the shade, aligned on an axis parallel to the plane thereof. The material employed for the loops 38 will generally be a low friction synthetic resinous material, such as polyethylene, polypropylene, the polyesters, the polyamides, the polytetrafluoroethylene-type resins, etc., and the loops should preferably be relatively wide to virtually eliminate any chance of the cords binding as they pass through the channels defined; most conveniently, standard electrical wiring harnesses may be used.

Aligned under each of the loops 38, against the rear surface of the body portion 18, are a number of guide rings 44 arranged (in rectangular, grid-like fashion) in rows and columns; they are most readily fixed in place by stitching them to the fabric, as at 46. A drawstring 48 is threaded through each column of rings 44 (being tied to the lowermost one), and through the associated guide loop 38 at the head of the column. All of the drawstrings extend toward a common side edge of the shade, with those to the right of the column that lies along the left-hand margin (as shown in the drawings) also passing sequentially through any intermediate loops.

As is best seen in FIGS. 1 and 6, in the installed condition a supporting rod 50 is received through the sleeve pocket 32 at the top of the shade, and is mounted (by means not shown) within the window frame opening, in a conventional manner. They are not otherwise attached to one another, so that the width of the shade can readily be adjusted on the rod. A stiffening strip 52 of appropriate length is inserted into the pocket 24 at the bottom of the shade, and helps to maintain proper conformation.

Figure 3:
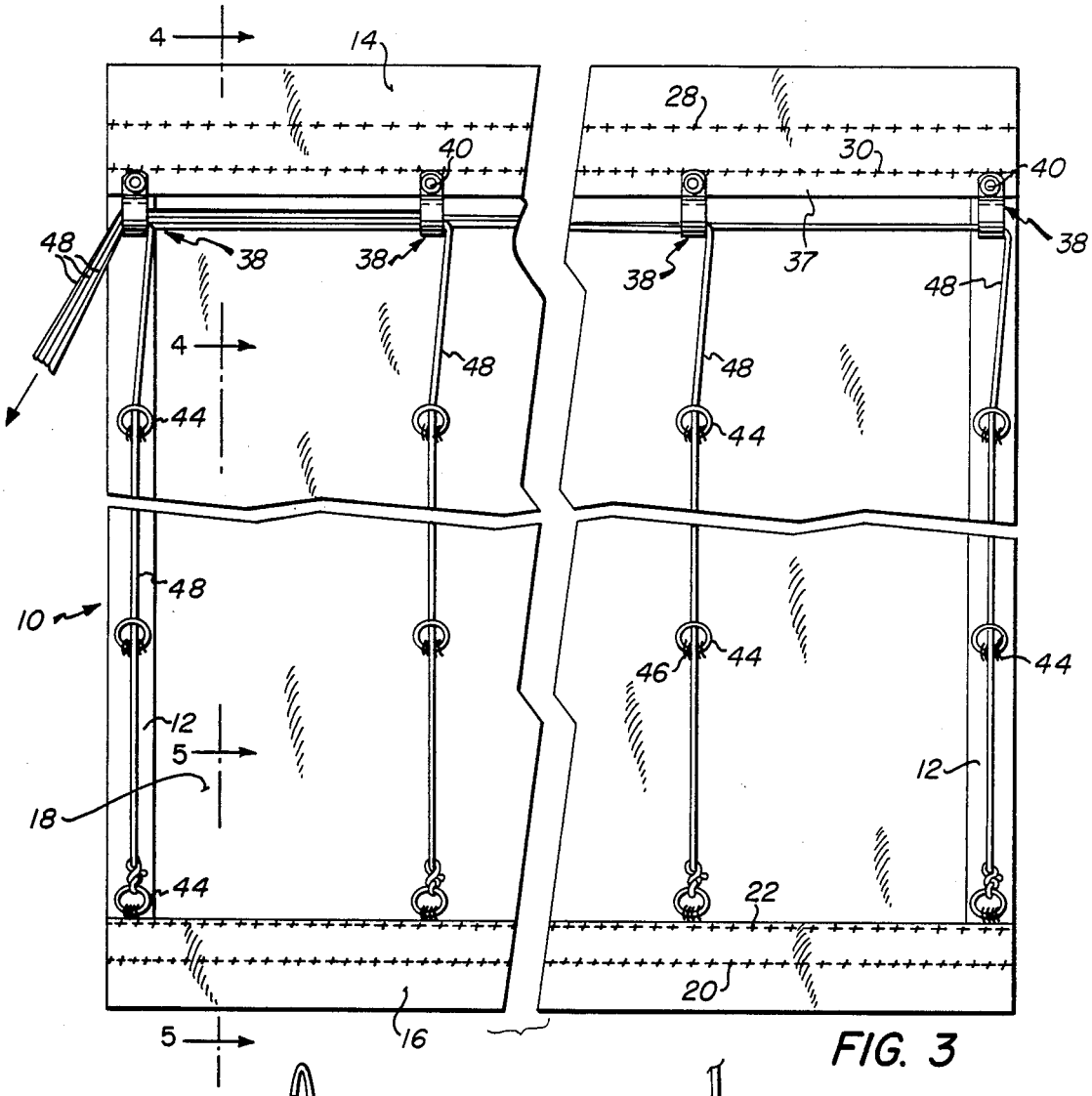
FIG. 3 is a fragmentary plan view of the rear side of the shade of the foregoing Figures, in flat condition.
Figure 4:
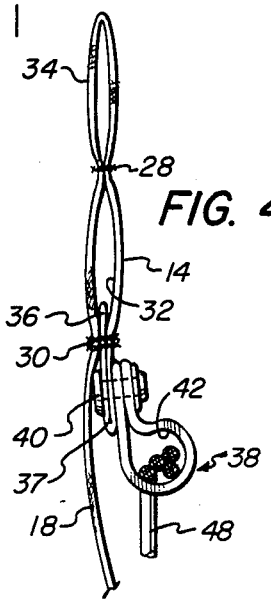
FIG. 4 is a fragmentary sectional view of the top portion of the shade, taken along line 4—4 of FIG. 3 and drawn to a scale enlarged therefrom.
Figure 5:
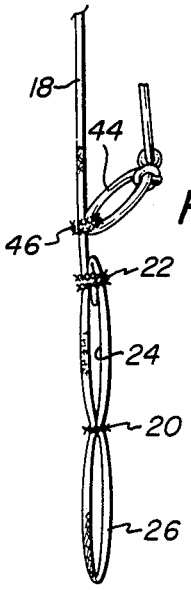
FIG. 5 is a view similar to FIG. 4, taken along line 5—5 of FIG. 3 and showing the bottom portion of the shade.

Operation will be self-evident, and simply entails simultaneously pulling the several drawstrings 48 in the direction indicated by the arrow in FIGS. 3 and 6, thereby exerting lifting force upon the lowermost rings 44 and elevating the shade from the position of FIG. 1 toward that of FIG. 6. As best shown in the latter Figure, when the shade is elevated a series of swags or poufs form naturally, which extend generally laterally across the panel at each level at which a row of rings 44 is provided (such a swag will not of course form at the level of the loops 38 because no lifting force is exerted by the drawstrings 48 thereat). The orientation and open configuration of the loops 38, coupled with the rigidity and low-friction character of the material of which they are made, facilitates free and non-binding movement of the drawstrings 48, and thereby ensures smooth and reliable operation of the shade.

Because the loops 38 are attached to the flange 37, rather than to the supporting rod 50, the shade can be furnished to the customer in a prestrung condition, without the rod and with no concern about precise window dimensions. This manner of attachment also minimizes any tendency for the material to shift on the rod, when the drawstrings are pulled; if, however, shifting is not a matter of concern, the loops might also be attached to the sleeve portion of the shade, above the flange 37. The double-thickness flap 37 is of course advantageous from the standpoint of conveniently providing desirable reinforcement, to prevent the rivets 40 from tearing from the fabric and thereby causing premature failure of the shade. The use of a single piece of fabric, folded to form the sleeve pockets and the flap for attaching the loops, is also most advantageous from the standpoint of manufacturing economy and simplicity. It is evident that hanging of the shade will be easily achieved, requiring only that the supporting rod be inserted into the sleeve formed in the panel, and then mounted within or upon the window frame in a conventional manner.

Figure 2B:
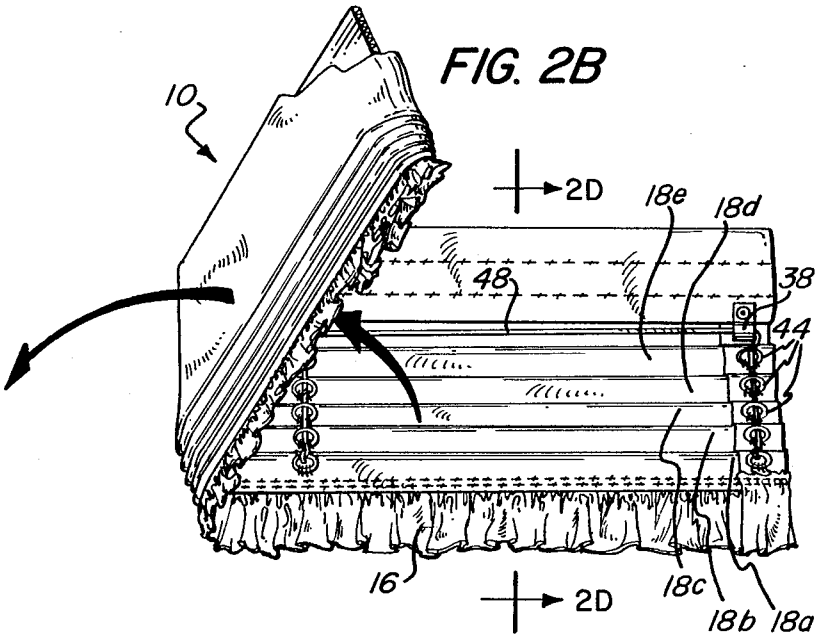
FIG. 2B is a perspective view showing the drapery article removed from the bag and partially unfolded, with a section broken away to s a cardboard packaging insert.
Figure 2A:
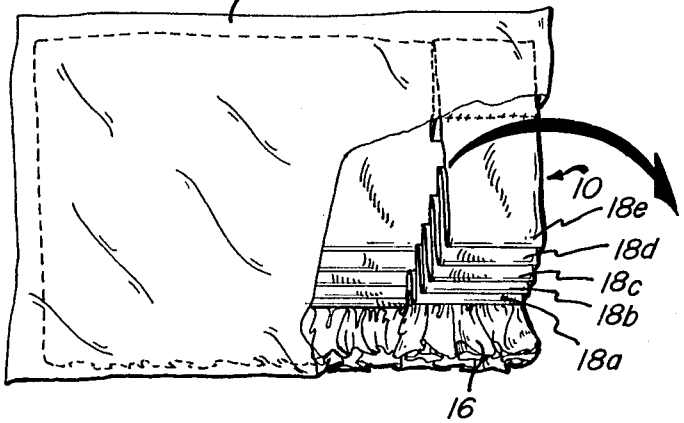
FIG. 2A is plan view of a drapery package assembly embodying the present invention, with a section of the bag containing the drapery article broken away to show the contents.

Turning now in greater detail to FIGS. 2A–2D of the drawings, the unique manner of folding the shade, embodied in the assembly and method of the present invention, is illustrated. FIG. 2A shows the fully folded shade (described above) contained within a bag 54. In this instance, the bag is made of plastic, but obviously other receptacle constructions can be used for packaging the drapery article and for maintaining its properly folded condition during shipment; indeed, the retaining means may take a completely different form, and clips, bands, fasteners, and the like, may be used in appropriate circumstances.

Figure 2C:
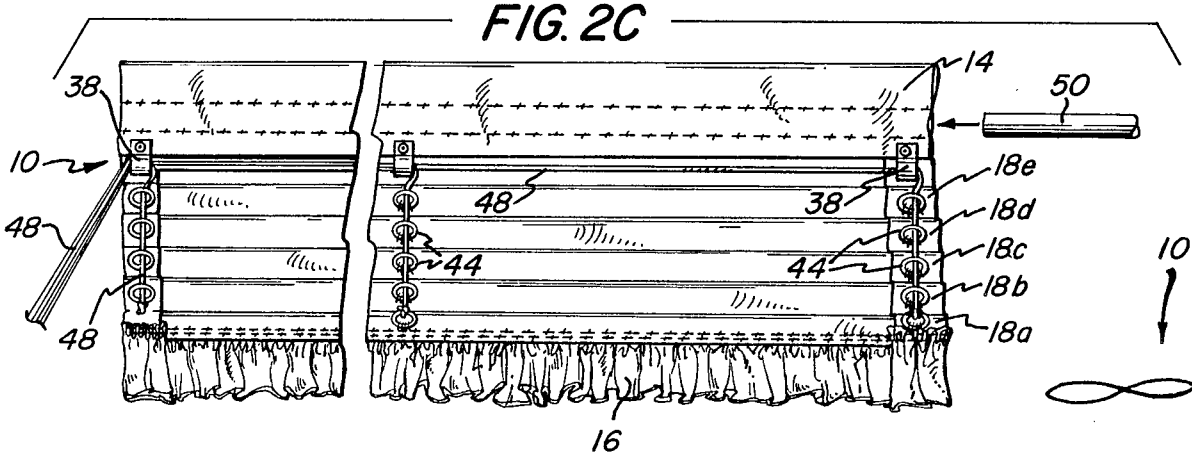
FIG. 2C is a fragmentary plan view of the drapery article fully unfolded laterally but not longitudinally.

Although the sequence of FIGS. 2B and 2C suggests unfolding of the shade from its as-packaged condition, the Figures also serve (together with FIG. 2D) to illustrate the manner in which the shade is folded from the flat condition of FIG. 3. Thus, a series of pleats **18*a*–18*e* is formed across the width of the panel 10 by folding it longitudinally upon itself along laterally extending (imaginary) lines corresponding to the rows of guide rings 44. As will be noted from FIG. 2D, the outermost pleat 18*a* (viewed from the reverse or rear surface of the drape) is formed at about the level of the lowermost row of rings 44, with pleats 18*b*–18*e* lying sequentially inwardly and at approximately the levels of the progressively upward rows of rings. This corresponds to the pattern of poufs that form naturally as the shade is elevated by operation of the drawstrings 48**, as described above.

The first pouf (corresponding to pleat **18*a*) is formed as the lowermost row of rings 44 are drawn upwardly and encounter the adjacent row of rings; the pouf corresponding to pleat 18*b*** is formed as a second row of rings approaches the third, and so on until the shade is elevated to its full height. Because the pleats shown in FIGS. 2A–2D are made at locations corresponding to the poufs that form, any creases resulting from the initial folding are substantially obscured by, or tend at least to be unobjectionably blended into, the natural swags of the hung shade, giving it a relatively wrinkle-free and very neat appearance.

The shade will of course be quite wide when it is fully extended in the lateral direction, and therefore it will normally either be folded or rolled to reduce it to a convenient size for transport and handling. Such folding is indicated in FIG. 2B (conveniently on a flat cardboard insert, not numbered), ultimately to produce the most compact configuration of FIG. 2A (rolling on a cardboard tube is not illustrated, but the procedure will be self-evident). Although it is apparent that, in the condition of FIG. 2A, some longitudinally extending folds are produced, it will be noted that the number of such folds is minimal and that, since they are made only after the pleats are formed, any longitudinal creasing will be relatively gentle and unobjectionable. Rolling of the pleat-folded drapery is considered a less-desirable alternative because it tends to produce excessive amounts of objectionable wrinkling, albeit that there will be substantially less such wrinkling than if the shade were first folded with longitudinally rather than laterally, extending folds.

Figure 2D:
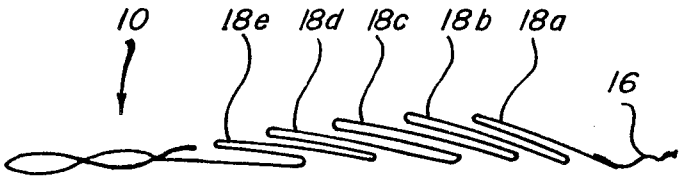
FIG. 2D is a cross-sectional view of the drapery article taken along line 2D—2D of FIG. 2B.

It will also be appreciated that stringing of the shade, once it is in the pleat-folded condition of FIGS. 2C and 2D, will be much faster and more efficient than doing so with the panel extended to its full length. Obviously, disposing the rings 44 and the loop 40 of each column closely adjacent to one another will facilitate threading of the drawstrings 48 therethrough. By way of brief explanation, a typical stringing sequence (with the shade first pleated) would involve withdrawing a length of cord from a spool, threading it laterally through the loops 48 along the top of the shade and then longitudinally through the rings 44 of one column, tying the free end to the lowermost ring and cutting the cord from the rest of the supply. The same procedure would be repeated, threading lengths of the cord through the remaining columns of rings until the shade is fully strung.

It will be apparent that the length to which the cord is cut must be measured to ensure that a sufficient amount will be available, not only for operation of the shade after it is installed but also to avoid unthreading during installation. This is conveniently accomplished, in accordance with the present invention, by using the following formula:

$$D_n = 1.5\ L + 11\ (n-1)$$

Obviously, the further any particular drawstring is from the lateral edge at which they are all gathered, the longer it will have to be; therefore, in the formula "n" represents the position of the drawstring relative to the edge, number "1" being closest (and hence shortest), number "2" next in position and length, and so on. The length of the particular drawstring or cord indicated by the subscript "n" is designated "D", and that of the panel is designated "L", both expressed in inches.

Because, in its as-received condition, the shade is opened to its full width simply by unfolding it laterally (i.e., along any longitudinal folds, but not the laterally extending ones), the mounting rod can be inserted through the sleeve portion 32 without extending the panel in any way that would involve movement of the drawstrings through the guide elements. In the course of mounting the shade upon the rod it will normally be gathered laterally, thereby making a portion of each drawstring available to accommodate the longitudinal extension of the panel that occurs upon hanging. Consequently, a considerable amount of cord can be saved, as compared to that which is necessary to permit lateral extension of a drape in which the folds are predominantly longitudinal (i.e., the norm), to facilitate insertion of the mounting rod.

To illustrate, a typical panel 84 inches wide and 48 inches long may be assumed. Therefore, if it is not to be pulled from the furthest loop when the panel is in a fully open, flat condition, the longest cord would have to be about 132 inches in length. Also assuming a typical 21-inch spacing between drawstrings, such a shade would have five cords; applying the foregoing formula to determine the length of the longest drawstring (i.e., the fifth):

$$D_5 = 1.5\ (48) + 11\ (4)$$

Thus, the cord would be about 116 inches in length, representing a savings of almost 14 percent, as compared to a drape that is pleated lengthwise.

It will be appreciated that the formula given above need not be strictly applied, and that deviations on the order of ten percent will generally be tolerable. It will also be appreciated that some portion of the drawstrings will normally be cut off during installation, to bring the ends to the same height, convenient for operation. Nevertheless, it can be seen that the amount of cord waste can be significantly reduced by use of the packaging method described herein.

Although pop rivets have been shown for affixing the loops, it will be understood that other types of fasteners may be substituted. Also, while the several parts of the shade will normally be sewn to one another, since they will usually be made of cloth, other means may be employed where appropriate; for example, if the shade were to be fabricated from a thermoplastic sheet material, heat sealing would be a suitable technique for joining the various sections. Finally, although a one-piece construction has been illustrated, it will be appreciated that the shade may be made from two or more separate pieces, which may be different fabrics or materials, if so desired.

Thus, it can be seen that the present invention provides a novel drapery package assembly comprised of a prestrung drapery article which is folded to enable convenient handling and shipping, and yet which facilitates installation and minimizes the amount of unsightly wrinkling in the hung curtain or shade. The assembly enables substantial enhancement of the economy and efficiency of manufacture, and of the convenience and ease of installation. A novel method for producing a packaged, prestrung drapery article is also provided, which method is of enhanced efficiency and economy, increases the convenience and simplicity of installation, and minimizes the amount of unsightly wrinkling apparent in the hung drapery.

Having thus described the invention, what is claimed is:

1. A drapery package assembly, including: a prestrung and unmounted drapery article comprised of a panel of supple material having means defining a rod-receiving sleeve portion extending laterally along the upper margin thereof and being compressible therealong for hanging said article in a laterally gathered condition, a multiplicity of guide elements arranged in a plurality of rows and a plurality of columns on one side of said panel, and a plurality of drawstrings attached to the lower portion of said panel at laterally spaced locations corresponding to said columns of guide elements, said drawstrings being threaded upwardly through said guide elements to the uppermost row thereof, and being guided thereby to one lateral edge of said panel for simultaneous operation of the drapery article when installed to elevate said lower portion thereof, such operation causing said panel to fold upon itself longitudinally along generally laterally extending natural fold lines at levels corresponding to said rows of guide elements other than said uppermost row, at least the portion of said panel other than said sleeve portion and said lower portion being of uniform suppleness throughout, said unmounted drapery article being folded upon itself in a series of overlapping pleats formed along said other rows of guide elements, substantially without gathering in the lateral direction and substantially without longitudinally extending creases; and means for maintaining said article in such pleat-folded condition, whereby said drapery article requires substantially no extension from its pleated-folded condition to enable insertion of a mounting rod through said sleeve portion for installation, and whereby said article, when hung, will be substantially free of creases, other than those that extend generally laterally along said natural fold lines and are associated with said pleats.

2. The assembly of claim 1 wherein said shade is subsequently folded upon itself in a lateral direction, and wherein said means for maintaining said shade comprises a bag or like receptacle.

3. The assembly of claim 1 wherein said panel is of generally rectangular configuration and said supple material of which it is made is a cloth fabric.

4. In a method for producing a packaged, prestrung and unmounted drapery article fabricated from a supple material having a multiplicity of guide elements arranged in rows and columns on one side of the panel and a plurality of drawstrings operable, when the article is mounted, for elevating the bottom portion thereof, such operation causing the panel to fold upon itself longitudinally along generally laterally extending natural fold lines at levels corresponding to the rows of guide elements other than the uppermost row thereof, the steps comprising:

providing a panel of supple material having means defining a rod-receiving sleeve portion extending laterally along the upper margin thereof, and having a multiplicity of guide elements arranged in a plurality of rows and in a plurality of columns on one side of said panel, at least the portion of said panel other than said sleeve portion and said bottom portion being of uniform suppleness throughout, said article being compressible along said sleeve portion for hanging said article, when mounted, in a laterally gathered condition;

providing a plurality of drawstrings;

longitudinally folding said unmounted panel repeatedly upon itself along said other rows of guide elements to form a series of laterally extending overlapping pleats therein, with said guide elements exposed;

threading said drawstrings through said guide elements to extend from one lateral edge of said panel along said uppermost row of said elements, and to said bottom portion of said panel with one of said drawstrings passing through each of said columns of guide elements;

affixing an end portion of each of said drawstrings to said panel at a point adjacent the lower end of each of said columns of guide elements; and providing means for maintaining said unmounted article in said longitudinally folded condition of said panel.

5. The method of claim 4 wherein said threading is carried out subsequent to said step of longitudinally folding said panel.

6. The method of claim 5 additionally including the step of cutting pieces of cord from a continuous-length supply thereof to provide said drawstrings, said step of threading each of said drawstrings preceding said steps of affixing said end portion and cutting said cord.

7. The method of claim 4 additionally including the steps of laterally folding said longitudinally folded panel upon itself at least one.

8. The method of claim 7 wherein said article maintaining means is a bag or like receptacle.

* * * * *